US008794505B1

(12) United States Patent
Richardson

(10) Patent No.: US 8,794,505 B1
(45) Date of Patent: Aug. 5, 2014

(54) MAILBOX GUARD AND NEWSPAPER HOLDING SYSTEM

(71) Applicant: Michael T. Richardson, Sandusky, OH (US)

(72) Inventor: Michael T. Richardson, Sandusky, OH (US)

( * ) Notice: Subject to any disclaimer, the term of this patent is extended or adjusted under 35 U.S.C. 154(b) by 0 days.

(21) Appl. No.: 13/750,201

(22) Filed: Jan. 25, 2013

(51) Int. Cl.
*A47G 29/12* (2006.01)
*A47G 29/122* (2006.01)

(52) U.S. Cl.
CPC ..... *A47G 29/122* (2013.01)
USPC ..... 232/39; 232/1 C; 232/17

(58) Field of Classification Search
USPC ..... 232/39, 38, 17, 45, 1 C; D99/32; 404/6; 40/606.06; 248/146, 156, 218.4
See application file for complete search history.

(56) References Cited

U.S. PATENT DOCUMENTS 4,187,978 A * 2/1980 Dowker ..... 232/39
4,852,847 A * 8/1989 Pagel ..... 248/548
4,875,622 A * 10/1989 Lents ..... 232/39
5,215,283 A * 6/1993 Gould ..... 248/145
5,411,206 A * 5/1995 Latham et al. ..... 232/39
5,460,326 A * 10/1995 Albanesius ..... 232/39
D365,190 S * 12/1995 Albanesius ..... D99/43
D385,679 S * 10/1997 Sullivan ..... D99/29
6,824,113 B1 * 11/2004 Gee et al. ..... 248/218.4
6,962,460 B1 * 11/2005 Pratt ..... 404/6
6,974,073 B1 * 12/2005 Snyder ..... 232/29
7,080,773 B1 * 7/2006 Tepley ..... 232/17
D580,625 S * 11/2008 Ballok ..... D99/43
7,559,457 B2 * 7/2009 Webber ..... 232/39
7,611,043 B2 * 11/2009 Black ..... 232/38
2006/0186188 A1 * 8/2006 Belanger ..... 232/38

* cited by examiner

*Primary Examiner* — William Miller
(74) *Attorney, Agent, or Firm* — Brouse McDowell; Michael G. Craig

(57) ABSTRACT

A mailbox protection system that deflects debris away from striking a mailbox that is attached to a bottom area of a mailbox post to reduce a moment of force on the post. A deflection assembly is held in place utilizing a cantilevered structural mounting assembly. The deflection assembly is physically separated from a proximate mailbox that the deflection assembly is configured to protect. The mailbox protection system minimizes or reduces the moment of a force causes by debris striking the deflection assembly.

13 Claims, 2 Drawing Sheets

MAILBOX GUARD AND NEWSPAPER HOLDING SYSTEM

FIELD OF THE INVENTION

This invention relates to mailboxes and more particularly, to a mailbox protection system for deflecting snow and debris away from a mailbox, while reducing the moment of force on a mailbox post, reducing damage and vandalism to the mailbox and reducing the risk of injury to a vehicle driver and/or passengers whose vehicle runs into the mailbox protection system. In addition, the mailbox protection system can serve as a newspaper holder.

BACKGROUND OF THE INVENTION

Various prior art devices have been developed for mailboxes to prevent them from being damaged by debris, e.g., that would normally strike the mailbox, when trucks, for example are plowing snow near them.

Installation of a roadside post and mailbox requires that the user follow the guidelines set by the U.S. Postal Service and the U.S. Department of Transportation tasked with verifying that the roads are safe for drivers. Therefore there are safety requirements for the installations of mailboxes and what makes it critical that if a driver hits the mailbox and/or a mailbox protection system, the risk of injury to the driver and/or passengers is minimized. There are three key factors outlined in the Department of Transportation guidelines. The first factor: A mailbox, for example, can fly off a post(s) when struck by a vehicle and go through the windshield injuring the driver and/or passengers in the vehicle that hit the post. The second factor: A mailbox post that is too rigid can create significant vehicle damage and driver and/or passenger injury because it is "unforgiving and/or inflexible". The third factor: When multiple mailboxes are mounted on a single horizontal beam, which is configured to be mounted to one or more posts. The horizontal beam, if detached from the mailbox posts in a collision, can act as a dangerous projectile through the windshield of the vehicle. All three factors or a combination thereof can result in serious injuries to the vehicle, driver, passengers, etc.

In addition, the moment of force is a measure of its tendency to cause a body to rotate about a specific point or axis and is well known by one of skill in the art. When a mailbox is struck by snow or a vehicle, for example this can exert a large moment of force on the mailbox post causing the mailbox post to break at or near its base. The moment is calculated as a force (F) times the length of a lever arm (r) and is well known by one of skill in the art. The larger the lever arm (r) for the same force applied the larger the moment of force.

A patent disclosing a mailbox guard is U.S. Pat. No. 4,852,847 issued to Pagel. This mailbox guard teaches a breakaway pin so if the mailbox is struck by a vehicle the breakaway pin releases and/or breaks and releases the mailbox from the post bracket and the post away from the vehicle (See e.g., Column 5, Lines 58-68). This invention is narrowly protected to cover a "breakaway pin" to protect the device by breaking away when the mailbox is stuck by snow, debris, etc. while not injuring the passengers in the vehicle, for example. The mailbox can be easily damaged by falling on the ground; and the mailbox and horizontal beam can be easily knocked off the post.

Another patent disclosing one such mailbox guard is U.S. Pat. No. 4,875,622, assigned to Waddell. This mailbox guard teaches a breakaway form of a curbside "imitation brick" mailbox that is formed from a block of Styrofoam, coated with successive layers of a mixture of stucco and lightweight aggregate filler, into a cutout of which a standard rural delivery mailbox fixture is placed. The Styrofoam block and mailbox can be easily damaged by snow and/or debris, for example. The damage can cause an unsightly structure, for example, that a town or city, for example might issue a citation or replacement order to the mailbox owner.

Yet another patent disclosing a mailbox guard system is U.S. Pat. No. 5,215,283, issued to Gould. This mailbox guard system also adds a guard rail that upon impact allows the mailbox(s) to rotate. However, snow and/or debris, for example can still damage the mailbox(s), the mailbox post(s) and the said invention suffers from numerous other deficiencies.

Therefore, it is an object of the present invention to provide a safe, effective and moment reducing snow and debris deflection assembly which can be configured as a newspaper holder which overcomes the drawbacks and problems mentioned above.

SUMMARY OF THE INVENTION

Accordingly, the present invention overcomes the limitations of the prior art by providing a unique and useful mailbox protection system and optional newspaper holder.

Consequently, the following presents a simplified summary of the invention in order to provide a basic understanding of some aspects of the invention. This summary is not an extensive overview of the invention. It is intended to neither identify key nor critical elements of the invention nor delineate the scope of the invention. Its purpose is to present some concepts of the invention in a simplified form as a prelude to the more detailed description that is presented later.

It is an object of the present invention to provide a mailbox protection system that is easy to assemble.

It is a further object of this invention to provide a mailbox protection system that can easily be attached to an existing mailbox post.

It is another embodiment of the present invention to configure the deflection assembly to act as an optional newspaper holder, as well.

It is yet a further embodiment of this invention to provide a fastenable and removable mail post cover that will cover the mailbox protection system mount opening in the mailbox post (e.g., the plastic post cover) when the system is removed, for the Spring, for example.

It is a further object of this invention to utilize a mailbox protection system that prevents or minimizes the damage to a mailbox and/or mailbox post from road debris or vandalism.

It is yet a further object of the present invention to provide a mailbox protection system that can be adjusted in the x, y and z axes.

It is yet another object of this invention to provide deflection assemblies of numerous sizes and shapes.

It is yet another object of this invention to provide a mailbox protection system that can be made from various materials.

It is yet another object of this invention to minimize or reduce the chance of a component of a mailbox protection system from impacting the windshield of a vehicle when striking the mailbox protection system.

It is a further embodiment of this invention that allows a mailbox protection system to collapse if struck by a vehicle.

It is a further embodiment of the invention where a mailbox protection system is low cost to manufacture.

It is yet a further object of the system to be made of various components, so that is one or more components are damaged they can be replaced without replacing the entire system.

It is another embodiment of the present invention to provide a deflection assembly that is separated spatially from a proximate mailbox so that when road debris strikes the deflection assembly, the deflection assembly does not come into contact with or damage the mailbox.

It is a further embodiment of this invention to provide a mailbox protection system that minimizes or reduces the moment of a force on the mailbox post caused by debris striking the deflection assembly.

It is yet a further embodiment of the invention to provide a cantilevered structural mounting assembly that can telescopically shortened and/or collapse when struck by a vehicle.

DETAILED DESCRIPTION OF THE INVENTION

Figure 2:
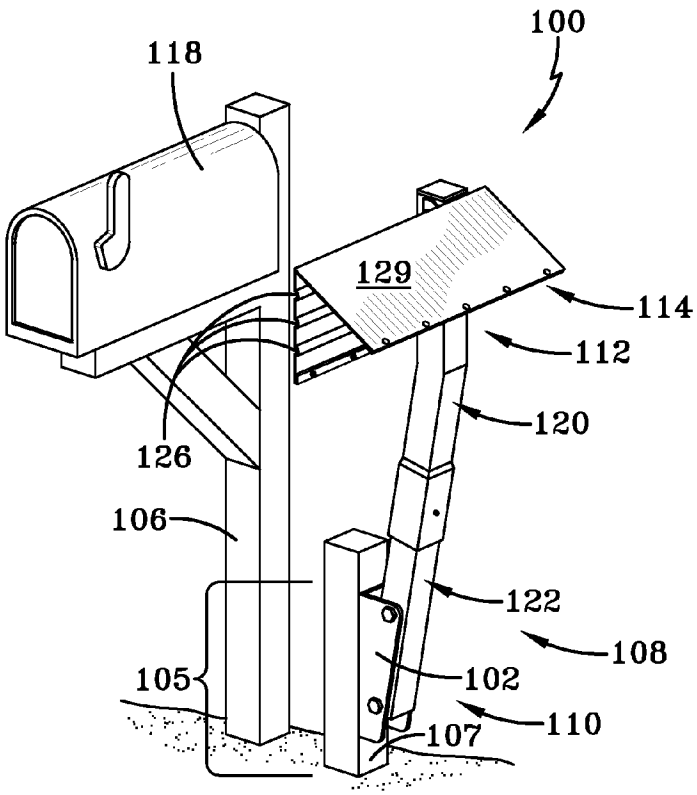
FIG. 2 illustrates an upper perspective view of the mailbox protection system mounted to approximately the base of a mailbox protection system mounting structure and/or surface independent of the mailbox post, according to one aspect of the invention.

One or more implementations of the present invention will now be described with reference to the attached drawings, wherein like reference numerals are used to refer to like elements throughout. The invention relates generally to mailboxes and ways to better protect the mailboxes and the mailbox posts from forces and moments caused by impact with road debris comprising, for example, mud, stones, snow and ice and in addition vandalism. The mailbox protection system can also be used as a newspaper holder.

Figure 1:
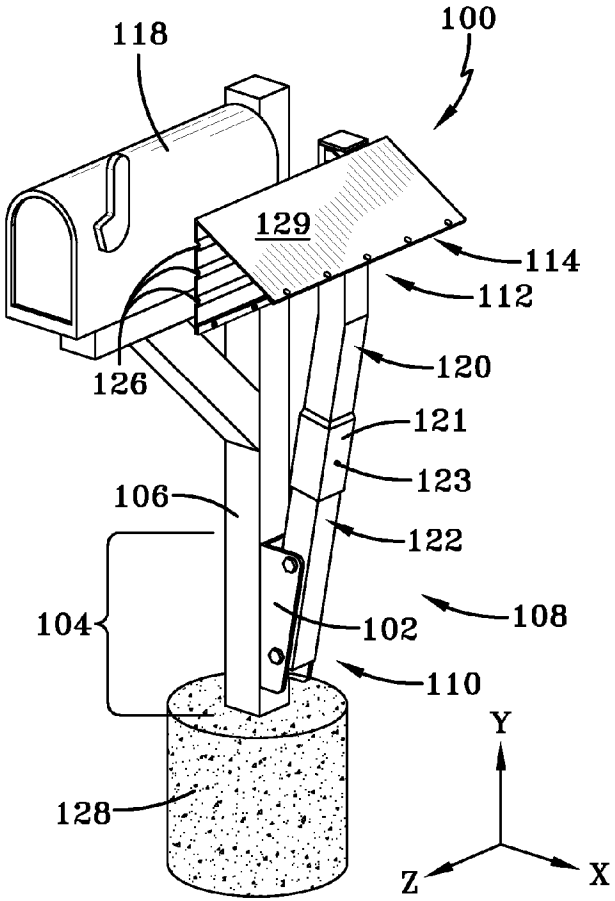
FIG. 1 illustrates an upper perspective view of a mailbox protection system and optional newspaper holder mounted approximately to the base of a mailbox post, according to one aspect of the invention.
Figure 4:
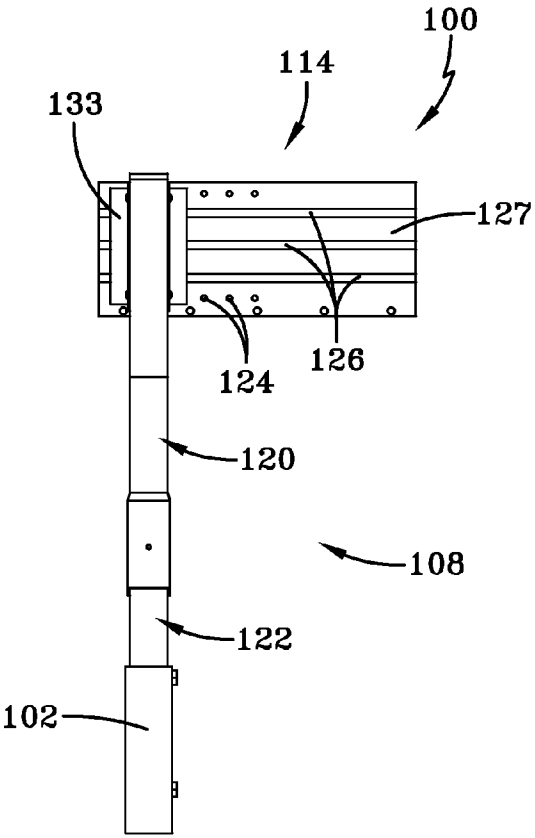
FIG. 4 illustrates a rear view of only the mailbox protection system shown in FIG. 1.
Figure 3:
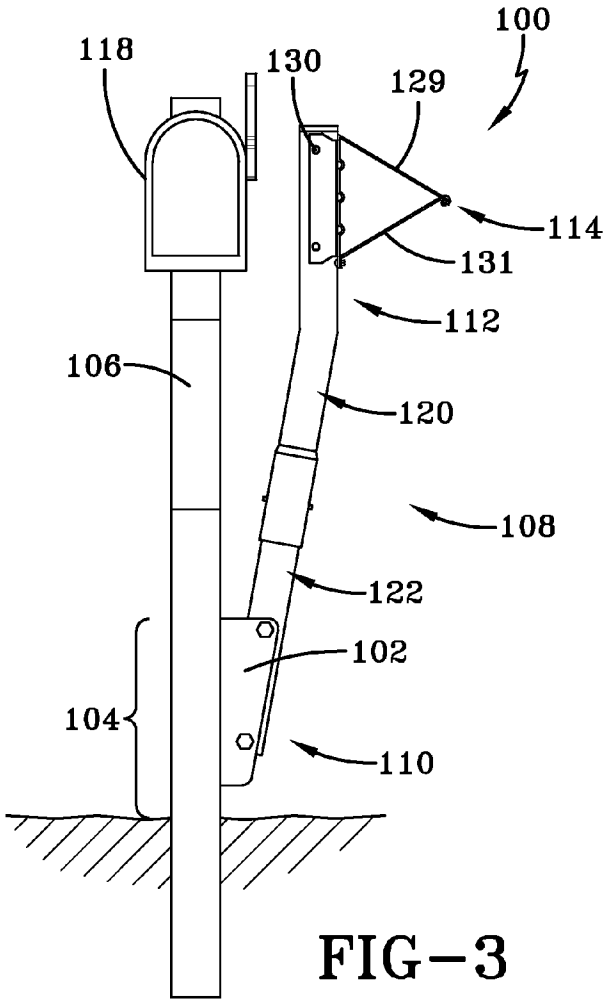
FIG. 3 illustrates a front view of the mailbox protection system shown in FIG. 1.

Referring now to FIGS. 1 and 3-4, the figures illustrate a preferred embodiment of a mailbox protection system 100. The only difference between FIGS. 1 and 3; and FIG. 2 is that FIGS. 1 and 3 illustrate the mailbox protection system 100 mounted on a mailbox post 106 and in FIG. 2 the mailbox 106 is mounted on a separate mailbox protection system mounting structure 107. A mounting bracket 102 illustrated in FIGS. 1 and 3 is non-fixedly attached to an approximately bottom area 104 (FIGS. 1 and 3) of the mailbox post 106 (e.g., FIGS. 1 and 3) to reduce a moment of force on the post 106 at the approximate bottom area 104, wherein the bottom area length, e.g., is in the Y axis and approximately eight inches or less. The mounting bracket 102 shown in FIG. 2 is attached to the bottom area 105 of the mailbox protection system mounting structure 107. The deflection assembly 114 is approximately 18 inches or greater in length. The deflection assembly 114 is approximately 6 inches or greater in height.

A mounting bracket however can be located in positions comprising below the soil surface, above the soil surface or mounted partially below the soil surface and on any surface comprising a post, a tree, a concrete wall, etc. Mounting devices comprising brackets, structures, locations and the like, for mounting a cantilevered structural mounting assembly (e.g., FIGS. 1-2) are well known to those of skill in the art. Although a mounting assembly 108 is illustrated with square tubing, other tubing shapes are well known by those of skill in the art, comprising, for example, round, oval, triangular and other shapes. In addition, a cantilevered structural mounting assembly can be configured with techniques comprising collapsing, telescoping downward, pistons, air shocks, a breakaway structure with breakaway components and the like if struck be a vehicle and other structures known by those of skill in the art. The mailbox protection system 100 utilizes the deflection assembly 114 that is designed and manufactured to deflect debris comprising snow, gravel, dirt and cinders, for example and reduce vandalism to the mailbox 118. In the embodiment shown in FIGS. 1-4 the deflection assembly 114 is shown as bent metal plates and fastened into a triangular shape, A deflection assembly can be configured in different shapes comprising: a round extrusion, a square extrusion, a rectangular extrusion, a triangular extrusion, for example, and made of materials comprising, metal, plastics, composites, injection molded components with stiffeners, honeycomb and other shapes and materials know by those of skill in the art. In addition, the deflection assembly 114 can also serve as a newspaper holder which eliminates the need for a traditional newspaper or magazine holder that can be unsightly, for example. The deflection assembly 114 is shown as a single size, however the size can be much larger or much smaller, non-symmetrical, and comprising additional sizes and shapes well known by one of skill in the art. The deflection assembly 114 can have removable and/or fixed end cap(s) (not shown) to allow it to be used as a newspaper holder with one open end, for example. In addition, two caps can be configured to form a completely enclosed deflection assembly. The cantilevered structural mounting assembly 108, for example, in FIG. 1 is non-fixedly attached at a mounting assembly first end 110 non-fixedly attached to the mounting bracket 102. A mounting assembly second end 112 is non-fixedly attached to a deflection assembly bracket 133 (See, e.g., FIG. 4). Although the mounting assembly 108 is illustrated as non-fixedly attached to various components, the attachments can be fixedly made, for example using welding, bonding and other techniques known by one of skill in the art. In addition, numerous techniques are known for attaching assemblies, comprising fasteners and fastening techniques, both fixed and/or non-fixed attachments that are well known by one of skill in the art.

The mailbox protection system 100 in FIG. 1 is configured so that the deflection assembly 114 is physically separated from a proximate mailbox 118. The separation allows the deflection assembly 114 and the proximate mailbox 118 to remain separated when or if the deflection assembly 114 is struck with debris. The deflection assembly 114 is configured to deflect all or a majority of debris both over and/or below the mailbox 118, wherein the cantilevered structural mounting assembly 108 comprises one or more tubular components, that can be configured to telescopically shorten or collapse when struck by a vehicle. In addition, a deflection assembly can comprise various sizes, known by one of skill in the art to accommodate various size mailboxes.

As mentioned above, a critical and novel feature of the mailbox protection system 100 is that it minimizes or reduces the moment of a force on the mailbox post 106 or the mailbox protection system mounting structure 107 caused by debris, vandals and the like striking the deflection assembly 114. Moments of force and techniques to lower or raise the values are well known by those of skill in the art. In this embodiment, the cantilevered structural mounting assembly 108 comprises a rectangular upper tube 120 with an expanded lower wider tube 121 that slides over a rectangular lower tube 122 with a collapsed upper section and a fastener(s) 123 (See e.g., FIG. 1) are installed to allow attachment of the upper and the lower tubes 120 and 122. Although the mailbox post 106 in the preferred embodiment, as illustrated in FIG. 1 is mounted into concrete 128 (FIG. 1) a post could be mounted with methods comprising brackets onto a concrete pedestal, buried in the ground, welding to a metal guard rail or with other mounting techniques known by one of skill in the art.

FIG. 4 illustrates a rear view of the deflection assembly 114 with mounting holes 124 in a back section 127 of the deflection assembly 114 so that the deflection assembly 114 can be moved horizontally and non-fixedly attached, in the z direction. In addition, the back section 127 of the deflection assembly 114 can be reinforced with ribs 126, as shown and other reinforcement structures known by one of skill in the art. In the preferred embodiment, fasteners 130 (FIG. 3) are used for mounting the deflection assembly 114. In addition, (as shown in FIGS. 3 and 4), the back section 127 and top section 129 of the deflection assembly 114 is a single piece of bent metal and a bottom section 131 (FIG. 3) is fastened to the top section 129 and the back section 127. Although a mailbox protection system 100 as is shown in FIGS. 1-4 is in one mounting location a mailbox protection system can easily be configured to be adjusted in the x, y and z axes (FIG. 1) by one of the skill in the art.

A mailbox protection system can be configured where a deflection assembly is configured so that a shape comprises an L-shape, a curvilinear shape and the like. The deflection assembly would then protect debris from oncoming traffic hitting an oncoming traffic side of a mailbox and a street side mailbox door. Ready access to opening, closing, inserting and removing mail from the mailbox could be configured by one of skill in the art.

Although the invention has been illustrated and described with respect to one or more embodiments, implementations, alterations, and/or modifications may be made to the illustrated examples without departing from the spirit and scope of the invention. In particular regard to the various functions performed by the above described components or structures (assemblies, devices, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "including" "includes", "having", "has", "with", or variants thereof are used in either the detailed description and the claims, such terms are intended to be inclusive in a manner similar to the term "comprising".

What is claimed is:

1. A mailbox protection system for deflecting debris, comprising:

a mounting bracket non-fixedly attached to an attachment location of a mailbox post;

a cantilevered structural mounting assembly comprising:

a first end non-fixedly attached to the mounting bracket; and a second end non-fixedly attached to a deflection assembly; and the deflection assembly disposed in a non-contact arrangement with a mailbox disposed adjacent to and spaced from the deflection assembly, the deflection assembly comprising a wedge shape formed by:

a first sheet formed to comprise a top section and a back section defining a V-shape and having two free edges, the back section fastened to the cantilevered structural mounting assembly; and a second sheet comprising a bottom section, the second sheet fastened to the two free edges of the first sheet;

the mailbox protection system configured to mitigate a moment of a force affecting the mailbox by transferring at least a portion of the moment of force to the attachment location of the mailbox post, resulting from debris striking the deflection assembly.

2. The system of claim 1, the mailbox post comprising one of:

a first mailbox post supporting the mailbox; or a second mailbox post installed proximate and adjacent to the first mailbox post.

3. The system of claim 2, the attachment location comprising one of:

a position adjacent to the ground level of the first mailbox post; and a position adjacent to the ground level of the second mailbox post.

4. The system of claim 1, the distance between the first end and the second end of the cantilevered structural mounting assembly is selectively adjustable.

5. The system of claim 1, the deflection assembly is configured to selectively receive a newspaper.

6. The system of claim 1, the deflection assembly sized to deflect substantially all of the debris around the mailbox.

7. A mailbox protection device for mitigating debris impact to a mailbox, comprising:

a mounting bracket engaged with an attachment location of a mailbox post; and a cantilevered structural mounting assembly comprising:

a first end engaged with the mounting bracket; and a second end engaged with a deflection assembly;

the deflection assembly disposed in a non-contact arrangement with the mailbox disposed adjacent to and spaced from the deflection assembly, the deflection assembly comprising a first sheet formed to comprise a top section and a back section defining a V-shape and having two free edges, the back section fastened to the cantilevered structural mounting assembly, and a second sheet comprising a bottom section, the second sheet fastened to the two free edges of the first sheet resulting in an elongated tubular triangular shape, the deflection assembly configured to deflect debris around the mailbox, the mailbox protection device configured to mitigate a moment of a force affecting the mailbox by transferring at least a portion of the moment of force to the attachment location of the mailbox post, resulting from debris striking the deflection assembly.

8. The device of claim 7, the distance between the first end and the second end of the cantilevered structural mounting assembly is selectively adjustable.

9. The device of claim 7, the mailbox post comprising one of:

a first mailbox post supporting the mailbox; or a second mailbox post installed proximate and adjacent to the first mailbox post.

10. The device of claim 9, the attachment location comprising one of:

a position adjacent to the ground level of the first mailbox post; and a position adjacent to the ground level of the second mailbox post.

11. A mailbox protection apparatus, comprising:

a deflection assembly disposed in a non-contact arrangement with and adjacent to a mailbox engaged with a mailbox post, the deflection assembly comprising a wedge shape configured to deflect debris around the mailbox; and a deflection assembly support, supporting the deflection assembly wherein the deflection assembly support is engaged with the mailbox post, the deflection assembly support comprising:

a mounting bracket engaged with an attachment location of the mailbox post, the attachment location disposed proximate to the ground-level of the mailbox post; and a single cantilevered structural mounting assembly comprising:

a first end engaged with the mounting bracket; and a second end engaged with the deflection assembly; the wedge shape formed by first and second pieces of metal, the first piece of metal formed to comprise a top section and a back section defining a V-shape and having two free edges, the back section fastened to the cantilevered structural mounting assembly, and the second piece of metal comprising a bottom section, the second piece of metal fastened to the two free edges of the first piece of metal;

the mailbox protection system configured to transfer at least a portion of a moment of a force resulting from debris striking the deflection assembly to the attachment location of the mailbox post.

12. The apparatus of claim 11, the distance between the first end and the second end of the single cantilevered structural mounting assembly is selectively adjustable.

13. The apparatus of claim 11, the wedge shape of the deflection assembly defining an elongated tubular triangular shape.

* * * * *